US010704857B2

(12) United States Patent
Ozanne

(10) Patent No.: US 10,704,857 B2
(45) Date of Patent: Jul. 7, 2020

(54) ARCHERY BOW WITH LOAD BALANCING LIMB SUPPORT

(71) Applicant: MCP IP, LLC, Sparta, WI (US)

(72) Inventor: Jeffrey A. Ozanne, La Crosse, WI (US)

(73) Assignee: MCP IP, LLC, Sparta, WI (US)

( * ) Notice: Subject to any disclaimer, the term of this patent is extended or adjusted under 35 U.S.C. 154(b) by 0 days.

(21) Appl. No.: 16/280,970

(22) Filed: Feb. 20, 2019

(65) Prior Publication Data

US 2019/0257610 A1 Aug. 22, 2019

Related U.S. Application Data

(60) Provisional application No. 62/632,885, filed on Feb. 20, 2018.

(51) Int. Cl.
*F41B 5/00* (2006.01)
*F41B 5/14* (2006.01)
*F41B 5/10* (2006.01)

(52) U.S. Cl.
CPC ..... *F41B 5/1403* (2013.01); *F41B 5/00* (2013.01); *F41B 5/10* (2013.01)

(58) Field of Classification Search
CPC ..... F41B 5/00; F41B 5/10; F41B 5/12; F41B 5/14
See application file for complete search history.

(56) References Cited

U.S. PATENT DOCUMENTS

| | | | | |
|---|---|---|---|---|
| 5,280,779 | A | 1/1994 | Smith | |
| 5,433,792 | A | 7/1995 | Darlington | |
| 5,445,139 | A * | 8/1995 | Bybee | F41B 5/12 124/23.1 |
| 5,464,001 | A | 11/1995 | Peck | |
| 5,487,373 | A | 1/1996 | Smith | |
| 5,720,267 | A | 2/1998 | Walk | |
| 5,749,348 | A * | 5/1998 | Oviedo-Reyes | F41B 5/12 124/25 |
| 5,931,145 | A * | 8/1999 | Oviedo-Reyes | F41B 5/12 124/20.3 |
| 5,931,146 | A * | 8/1999 | Schrader | F41B 5/10 124/23.1 |
| 7,918,218 | B1 | 4/2011 | Kronengold et al. | |
| 8,453,635 | B1 * | 6/2013 | McPherson | F41B 5/10 124/86 |
| 8,776,770 | B2 | 7/2014 | Batdorf | |
| 9,644,918 | B2 | 5/2017 | McPherson | |
| 10,323,899 | B2 * | 6/2019 | Missbach | F41B 5/1469 |

* cited by examiner

*Primary Examiner* — John A Ricci

(57) ABSTRACT

In some embodiments, an archery bow comprises a riser and a load balancing limb support assembly supported by the riser. The load balancing limb support assembly comprises a body comprising a first support portion and a second support portion. A limb assembly comprises a first limb portion and a second limb portion. The first limb portion is supported by the first support portion and the second limb portion is supported by the second support portion.

20 Claims, 11 Drawing Sheets

ARCHERY BOW WITH LOAD BALANCING LIMB SUPPORT

CROSS-REFERENCE TO RELATED APPLICATIONS

This application claims the benefit of U.S. Patent Application No. 62/632,885, filed Feb. 20, 2018, the entire content of which is hereby incorporated herein by reference.

BACKGROUND OF THE INVENTION

This invention relates generally to archery bows and more specifically to a limb support arrangement for archery bows.

Archery bows are generally known in the art. Some bows use limb assemblies that have two limb portions that extend substantially parallel to each other. The forces carried by the parallel limb portions are not necessarily the same. Cabling arrangements on bows can cause cam lean and twisting forces on the limbs.

There remains a need for novel archery bow designs that can provide greater efficiencies and bow longevity. There remains a need for novel limb support structures that provide benefits over prior support structures.

All US patents and applications and all other published documents mentioned anywhere in this application are incorporated herein by reference in their entirety.

Without limiting the scope of the invention a brief summary of some of the claimed embodiments of the invention is set forth below. Additional details of the summarized embodiments of the invention and/or additional embodiments of the invention may be found in the Detailed Description of the Invention below.

A brief abstract of the technical disclosure in the specification is provided as well only for the purposes of complying with 37 C.F.R. 1.72. The abstract is not intended to be used for interpreting the scope of the claims.

BRIEF SUMMARY OF THE INVENTION

In some embodiments, an archery bow comprises a riser and a load balancing limb support assembly supported by the riser. The load balancing limb support assembly comprises a body comprising a first support portion and a second support portion. A limb assembly comprises a first limb portion and a second limb portion. The first limb portion is supported by the first support portion and the second limb portion is supported by the second support portion.

In some embodiments, the load balancing limb support assembly is rigid. In some embodiments, the load balancing limb support assembly is arranged to pivot with respect to the riser.

In some embodiments, the load balancing limb support assembly comprises a fluid reservoir.

In some embodiments, an archery bow comprises a riser and a limb assembly supported by the riser. The limb assembly comprises a first limb portion and a second limb portion. A first limb support is arranged to support the first limb portion and a second limb support is arranged to support the second limb portion. The first limb support comprises a first fluid chamber and the second limb support comprises a second fluid chamber. The first fluid chamber is in fluid communication with the second fluid chamber.

In some embodiments, the support portions each comprise a piston structure.

In some embodiments, the fluid comprises a hydraulic fluid.

These and other embodiments which characterize the invention are pointed out with particularity in the claims annexed hereto and forming a part hereof. However, for a better understanding of the invention, its advantages and objectives obtained by its use, reference can be made to the drawings which form a further part hereof and the accompanying descriptive matter, in which there are illustrated and described various embodiments of the invention.

BRIEF DESCRIPTION OF THE DRAWINGS

A detailed description of the invention is hereafter described with specific reference being made to the drawings.

DETAILED DESCRIPTION OF THE INVENTION

Figure 1:
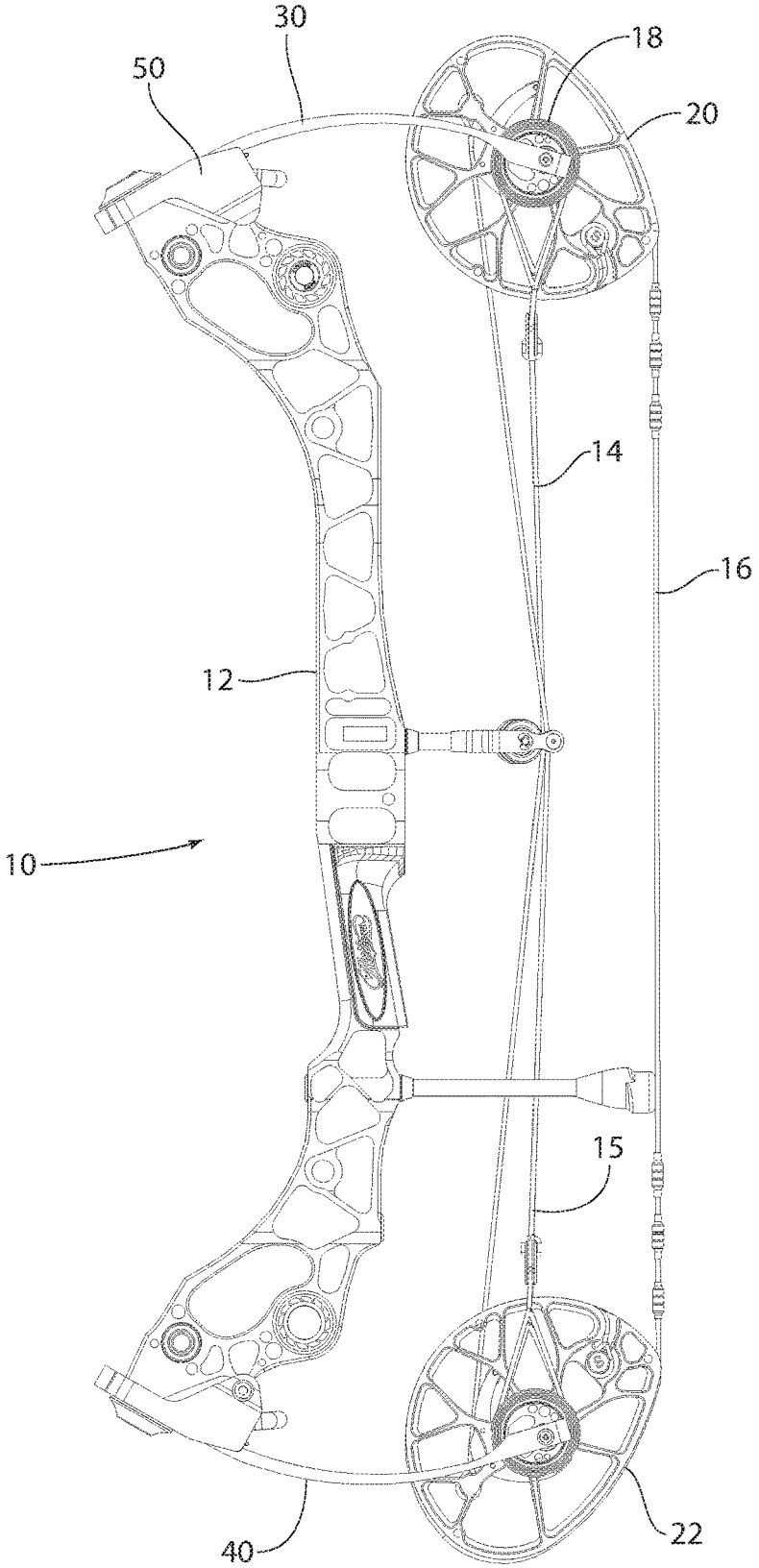
FIG. 1 shows an embodiment of an archery bow.

While this invention may be embodied in many different forms, there are described in detail herein specific embodiments of the invention. This description is an exemplification of the principles of the invention and is not intended to limit the invention to the particular embodiments illustrated.

For the purposes of this disclosure, like reference numerals in the figures shall refer to like features unless otherwise indicated.

FIG. 1 shows an embodiment of an archery bow 10. In some embodiments, the bow 10 comprises a riser 12, a first limb assembly 30 supporting a first rotatable member 20, and a second limb assembly 40 supporting a second rotatable member 22.

Desirably, the bow 10 comprises a bowstring 16. In some embodiments, a bowstring 16 extends between the first rotatable member 20 and the second rotatable member 22. In some embodiments, the bow 10 comprises a power cable 14. In some embodiments, the bow 10 comprises a second power cable 15. As shown in FIG. 1, the power cables 14, 15 are provided with force vectoring anchors 18, for example as disclosed in U.S. Pat. No. 8,020,544, the entire content of which is hereby incorporated herein by reference.

In some embodiments, the bow 10 comprises at least one limb cup 50. In some embodiments, a limb cup 50 is provided for each limb assembly 30, 40. In some embodiments, the riser 12 supports the limb cup 50, and the limb cup 50 supports a limb assembly 30. In some embodiments, a limb cup 50 and associated limbs are provided with features as disclosed in U.S. Pat. No. 8,453,635, the entire content of which is hereby incorporated herein by reference.

Figure 2:
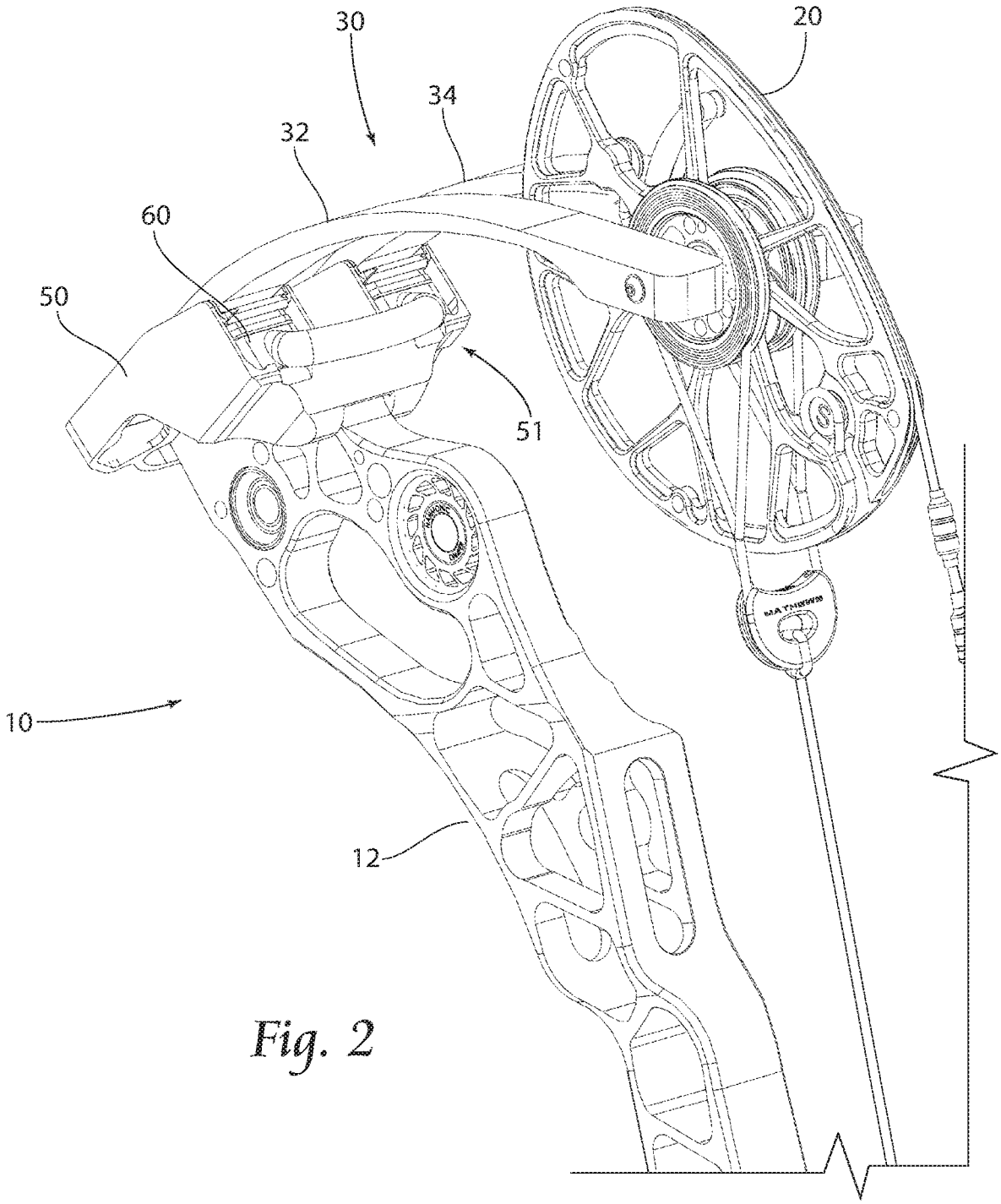
FIG. 2 shows a portion of the bow of FIG. 1 in greater detail.

FIG. 2 shows a portion of the bow 10 of FIG. 1 in greater detail. In some embodiments, a limb assembly 30 comprises a first limb portion 32 and a second limb portion 34 that collectively support a rotatable member 20. In some embodiments, the first rotatable member 20 is positioned between the first limb portion 32 and the second limb portion 34.

In some embodiments, the support provided to the first limb assembly 30 is balanced between the limb members 32, 34, such that supporting forces provided to the first limb portion 32 are the same as supporting forces provided to the second limb portion 34.

In some embodiments, the bow 10 comprises a load balancing limb support assembly 51 and the first limb portion 32 and the second limb portion 34 are supported by the load balancing limb support assembly 51. In some embodiments, the load balancing limb support assembly 51 comprises a fluid reservoir 60 and the first limb portion 32 and the second limb portion 34 are supported by the fluid reservoir 60. In some embodiments, loads from the first limb portion 32 and from the second limb portion 34 are applied to fluid within the fluid reservoir, and fluid flow allows for self-balancing or equalization of the support provided by the fluid to the limb portions 32, 34.

Figure 3:
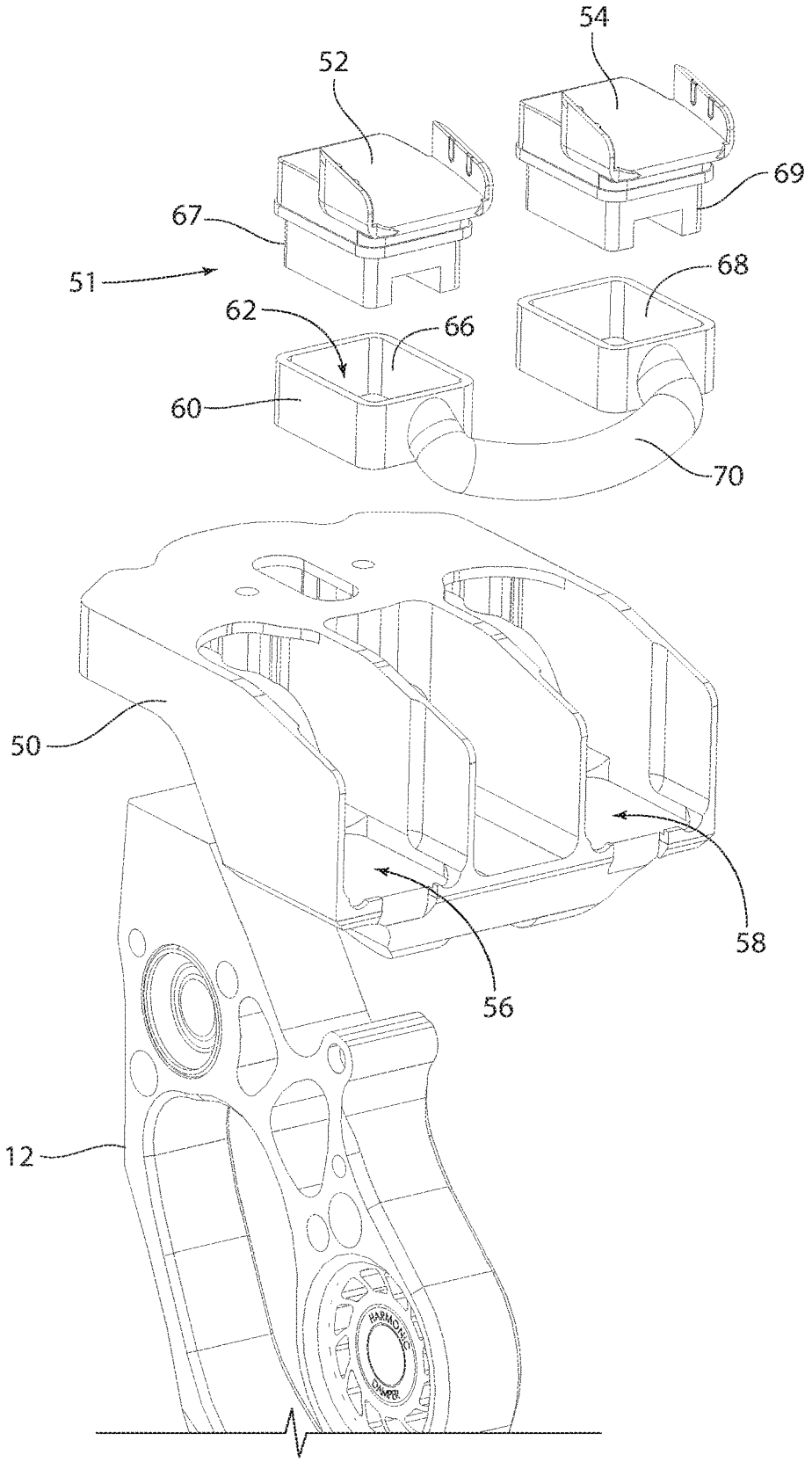
FIG. 3 shows an exploded view of an embodiment of a limb supporting structure.

FIG. 3 shows an exploded view of components shown in FIG. 2. In some embodiments, a fluid reservoir 60 comprises a body defining a cavity 62 arranged to contain a fluid. In some embodiments, the fluid reservoir 60 comprises a first fluid chamber 66 and a second fluid chamber 68. In some embodiments, the first fluid chamber 66 is positioned to primarily support the first limb portion 32 and the second fluid chamber 68 is positioned to primarily support the second limb member 34. Desirably, the first fluid chamber 66 is in fluid communication with the second fluid chamber 68. In some embodiments, a fluid passageway 70 provides a flowpath between the fluid chambers 66, 68.

In some embodiments, the first fluid chamber 66 provides support to a first piston 67, and the first piston 67 is arranged to support the first limb portion 32. Desirably, the first piston 67 is moveable with respect to the first fluid chamber 66, and movement of the first piston 67 varies the specific volume defined within the first fluid chamber 66.

In some embodiments, the second fluid chamber 68 provides support to a second piston 69, and the second piston 69 is arranged to support the second limb portion 34. Desirably, the second piston 69 is moveable with respect to the second fluid chamber 68, and movement of the second piston 69 varies the specific volume defined within the second fluid chamber 68.

In some embodiments, a piston 67, 69 supports an associated limb pad 52, 54, and the limb pads 52, 54 contact the respective limb portions 32, 34.

Any suitable fluid can be used in the fluid reservoir, such as liquids and/or gasses. In some embodiments, a hydraulic fluid is provided in the fluid reservoir 60.

In some embodiments, the limb cup 50 comprises a supporting surface that supports the load balancing limb support assembly 51. In some embodiments, the limb cup 50 defines a first cavity 56 and a second cavity 58. In some embodiments, the reservoir 60 is received in the limb cup 50. In some embodiments, the first fluid chamber 66 of the reservoir 60 is oriented in the first cavity 56 of the limb cup 50 and the second fluid chamber 68 of the reservoir 60 is oriented in the second cavity 58 of the limb cup 50.

Figure 4:
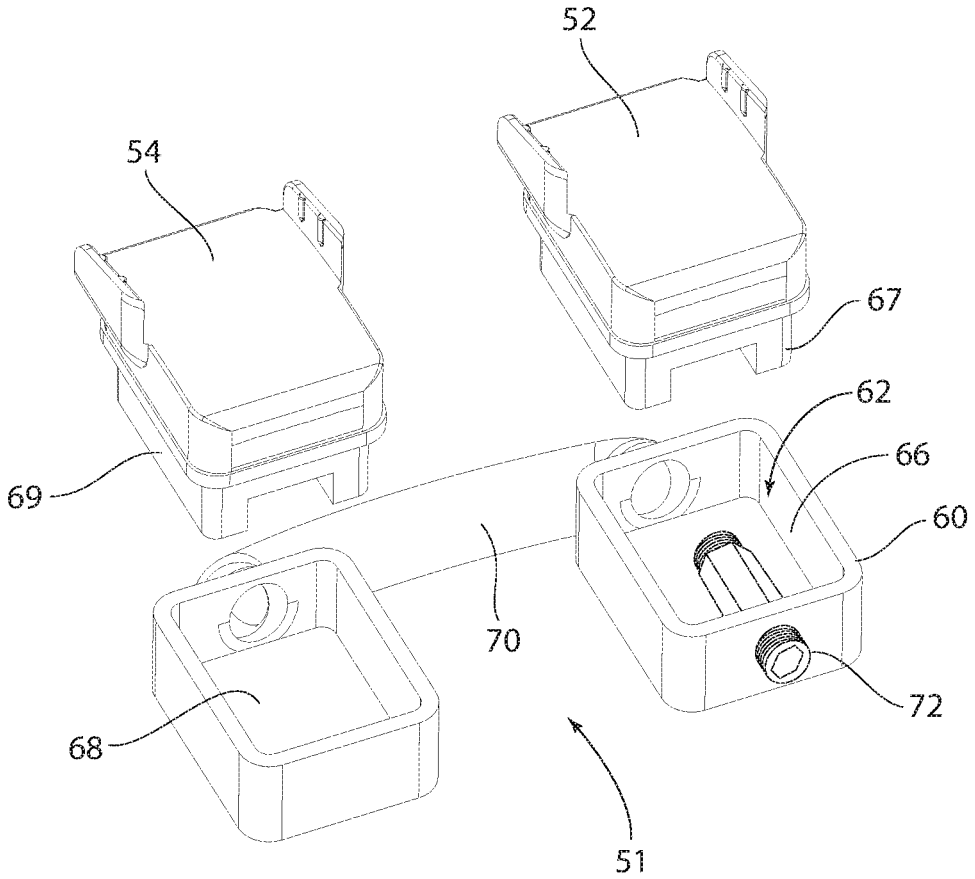
FIG. 4 shows an embodiment of a fluid reservoir.

FIG. 4 shows another view of an embodiment of a reservoir 60. FIG. 4 shows an example of the fluid passageway 70 being in fluid communication with the first fluid chamber 66 and second fluid chamber 68 of the reservoir 60.

In some embodiments, the reservoir comprises a valve 72 that controls fluid passage into and out of the reservoir 60. Any suitable type of valve 72 can be used, such as a one-way valve, check valve, Presta valve, Schrader valve, etc. In some embodiments, a valve 72 allows fluid to be added to or removed from the reservoir 60. In some embodiments, a valve 72 allows the specific pressure within the reservoir 60 to be adjusted.

In some embodiments, the fluid within the reservoir 60 is under a positive pressure (e.g. greater than atmospheric pressure) in an at-rest condition, prior to loading being applied by a limb.

Figure 5:
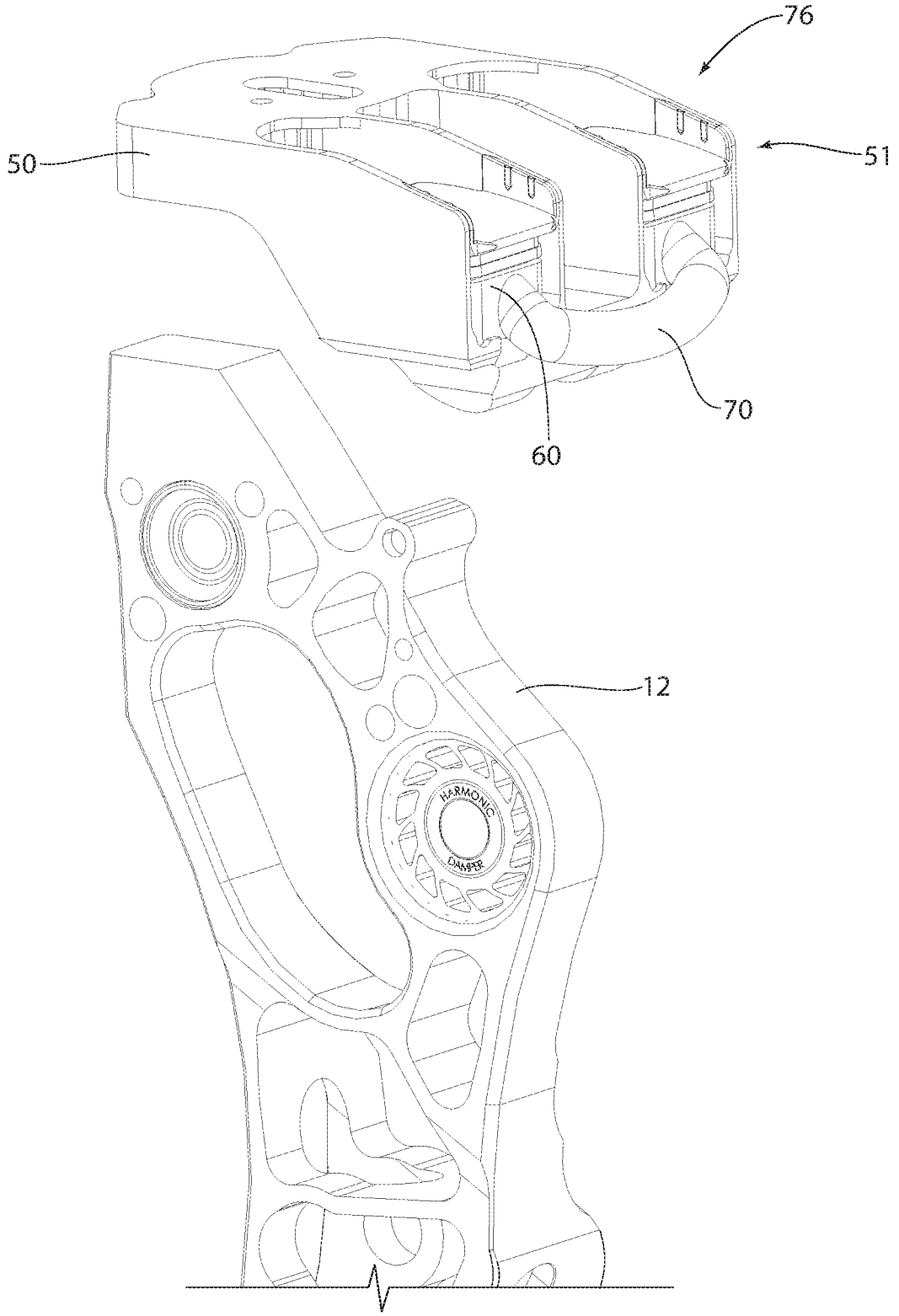
FIG. 5 shows a limb cup assembly comprising a fluid reservoir.

FIG. 5 shows an embodiment of a limb cup 50 and reservoir 60 in an assembled condition. In some embodiments, an assembly 76 comprising the limb 50 and reservoir 60 is supported by the riser 12. In some embodiments, the assembly 76 receives and supports the limb portions (e.g. 32, 34).

Figure 6:
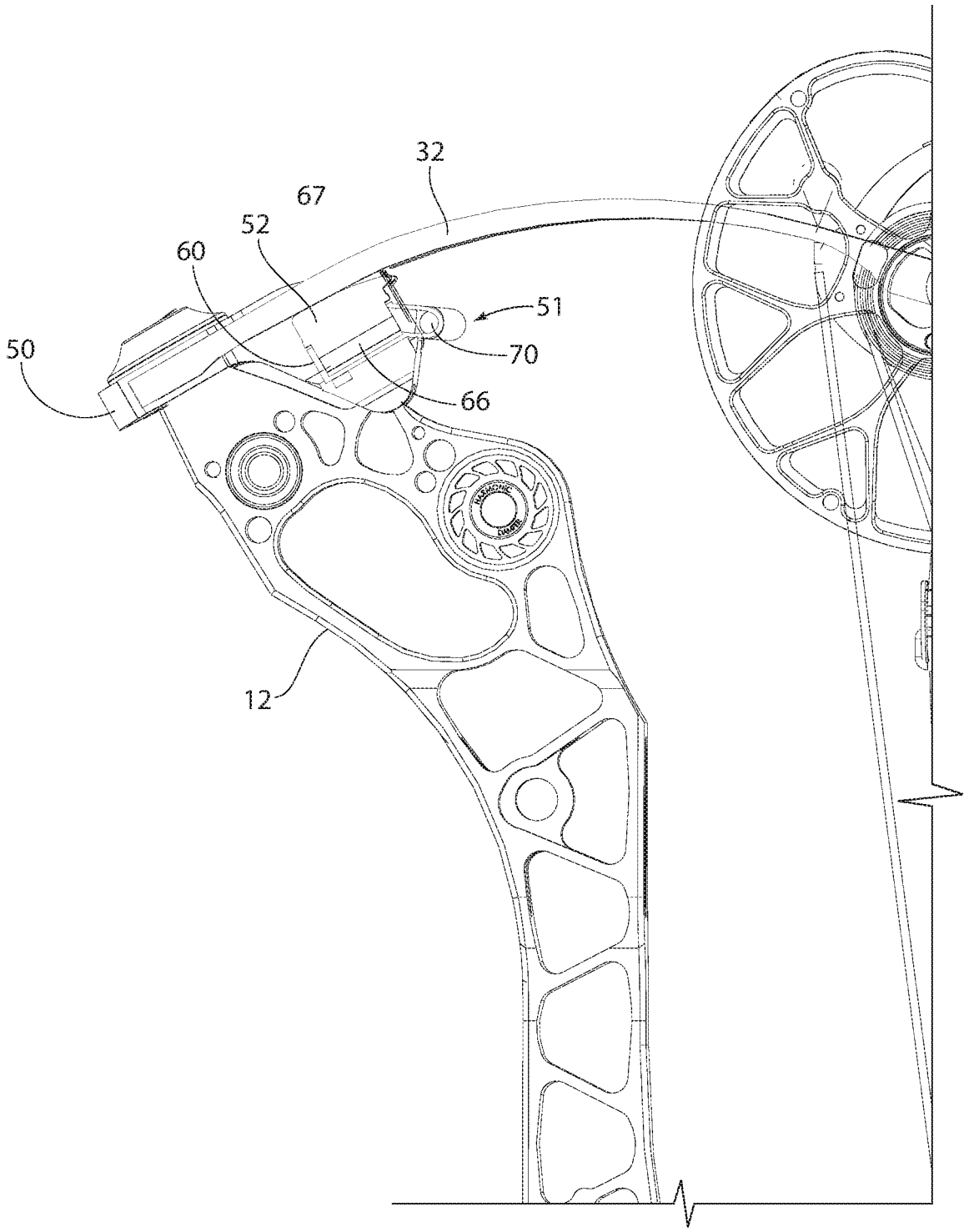
FIG. 6 shows a cross-sectional view of a portion of a bow comprising a limb supporting assembly and fluid reservoir.

FIG. 6 shows a cross-sectional view of an embodiment of a reservoir 60 and associated parts as described herein.

Figure 7:
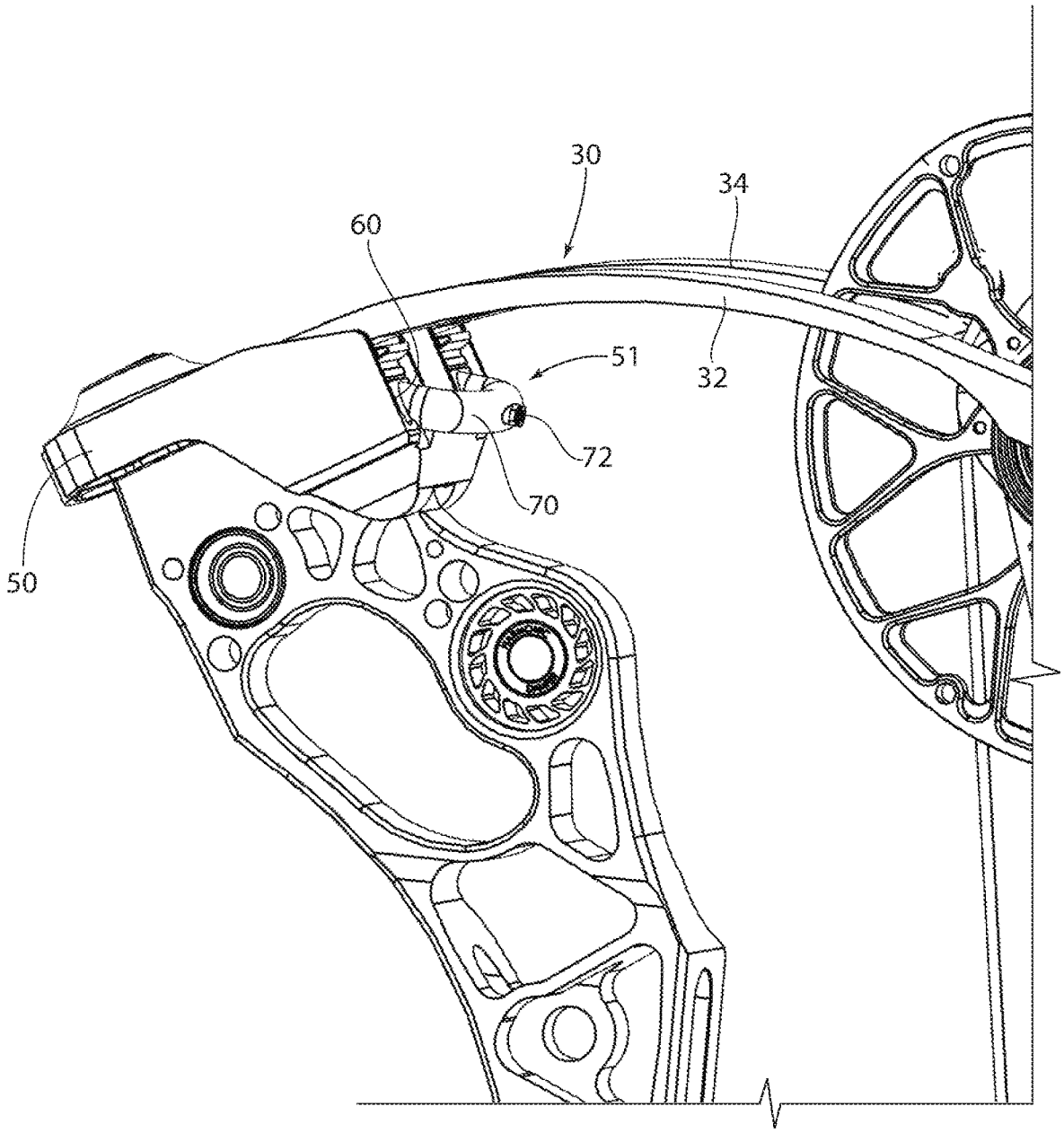
FIGS. 7-9 show another embodiment of a fluid reservoir.

FIG. 7 shows another embodiment of a load balancing limb support assembly 51 and another embodiment of a reservoir 60. In some embodiments, a valve 72 is attached to the fluid passageway 70 and is in fluid communication with the internal cavity (e.g. 62, FIG. 3) of the reservoir 60. In some embodiments, the valve 72 comprises a one-way valve that allows fluid to be added and/or removed from the internal cavity.

Figure 8:
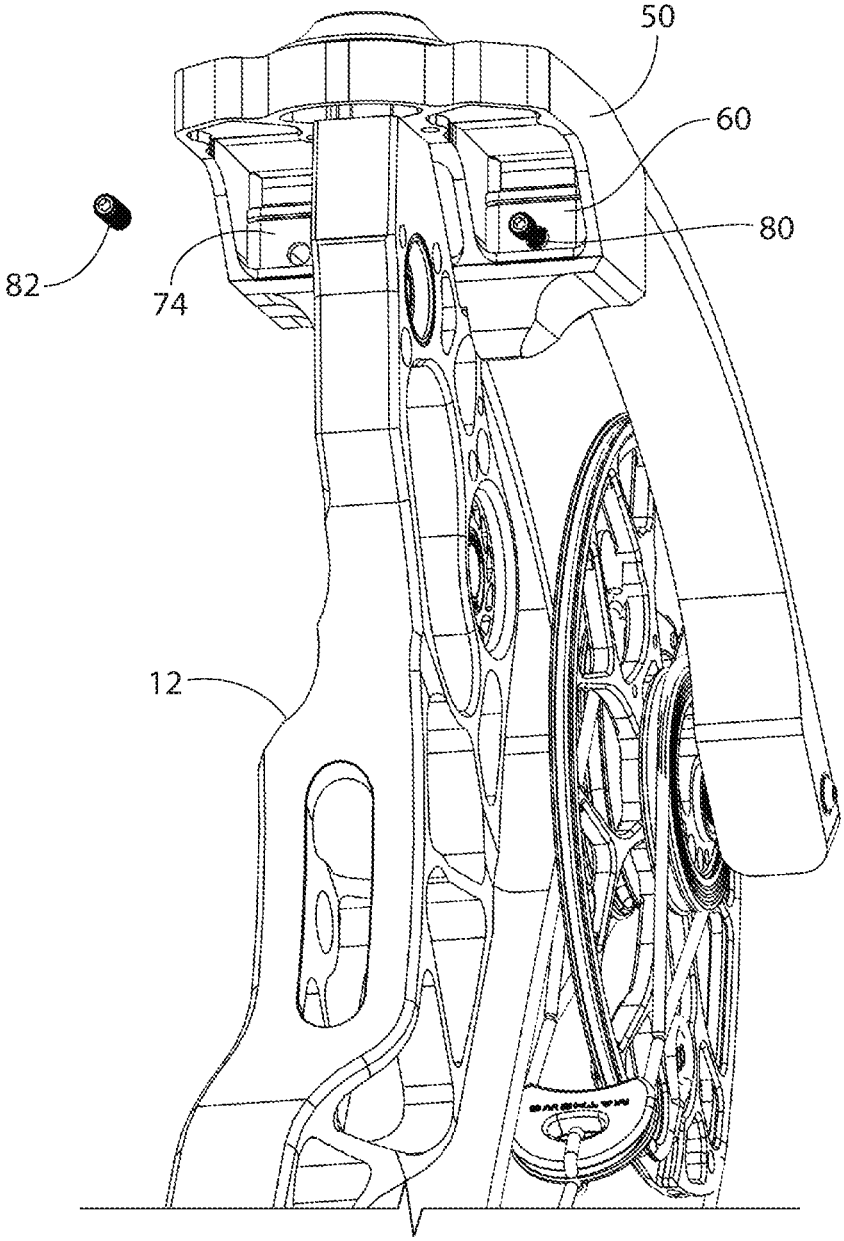
Figure 9:
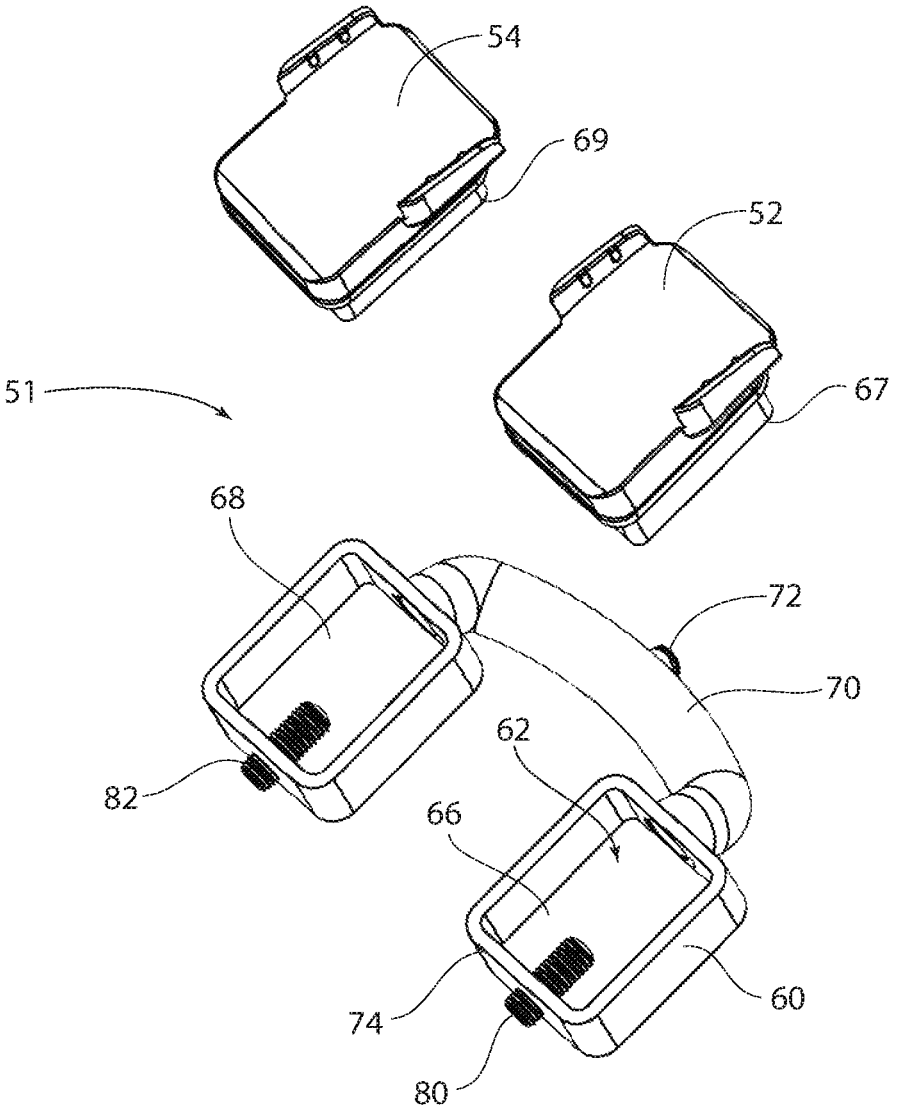

FIGS. 8 and 9 show the reservoir 60 of FIG. 7 from different angles. FIG. 9 shows parts of an embodiment of a reservoir 60 in an exploded view. In some embodiments, the reservoir 60 comprises a volumetric adjustment mechanism 80. In some embodiments, volumetric adjustment mechanism 80 comprises a moveable portion, wherein moving the movable portion adjusts the specific interior volume of the cavity 62 of the reservoir 60 that is available to be occupied by fluid. In some embodiments, a volumetric adjustment mechanism 80 comprises a set screw. In some embodiments, a volumetric adjustment mechanism 80 comprises helical threads that engage a threaded aperture in a wall portion 76 of the reservoir 60.

In some embodiments, a first volumetric adjustment mechanism 80 is provided in the first fluid chamber 66. In some embodiments, a second volumetric adjustment mechanism 82 is provided. In some embodiments, the second volumetric adjustment mechanism 82 is provided in the second fluid chamber 68. In some embodiments, a volumetric adjustment mechanism 80 can be used to adjust the fluid pressure level within the reservoir 60.

In some embodiments, the reservoir 60 comprises a pressure gauge arranged to show the fluid pressure level within the reservoir 60.

In some embodiments, a limb assembly 30 transmits a moment force to the riser 12 as a force couple comprising a tensile force and a compressive force. In some embodiments, the tensile force is transmitted by a limb bolt or other suitable fastener. In some embodiments, the compressive force is transmitted by the fluid reservoir 60. In some embodiments, adjustment of a limb bolt will change limb deflection and draw weight of the bow. In some embodiments, adjustment of the fluid pressure within the fluid reservoir 60 will change limb deflection and draw weight of the bow. In some embodiments, adjustment of the size of a cavity 62 (e.g. by a volumetric adjustment mechanism 80) can be used to change limb deflection and draw weight of the bow.

Figure 10:
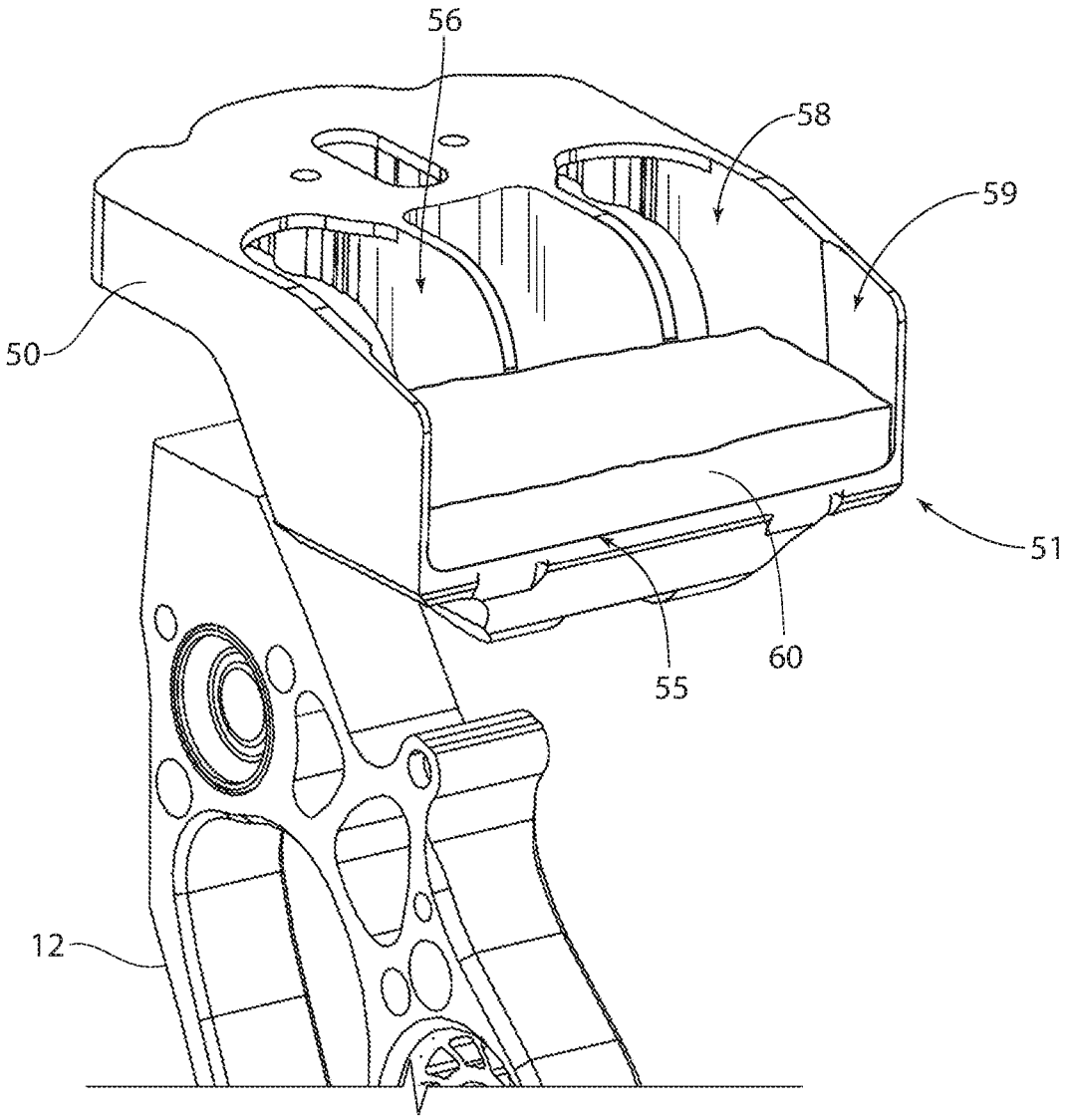
FIG. 10 shows another embodiment of a limb cup and another embodiment of a fluid reservoir.

FIG. 10 shows another embodiment of a limb cup 50 and another embodiment of a load balancing limb support assembly 51. In some embodiments, the limb cup 50 comprises a cavity 59 and the load balancing limb support assembly 51 is oriented in the cavity 59. In some embodiments, the cavity 59 spans across and/or comprises a portion of the first cavity 56 and a portion of the second cavity 58. In some embodiments, the limb cup 50 comprises a supporting surface 55 arranged to support the load balancing limb support assembly 51. In some embodiments, a supporting surface 55 comprises a floor of the cavity 59.

In some embodiments, a fluid reservoir 60 is supported by the supporting surface 55 and the fluid reservoir 60 supports the first limb portion and the second limb portion. In some embodiments, a fluid reservoir 60 comprises a material that is soft, flexible and/or non-rigid, for example comprising a bag or balloon containing a fluid. In some embodiments, a sidewall of flexible material comprises a first support portion arranged to support a first limb portion and a second support portion arranged to support a second limb portion.

Figure 11:
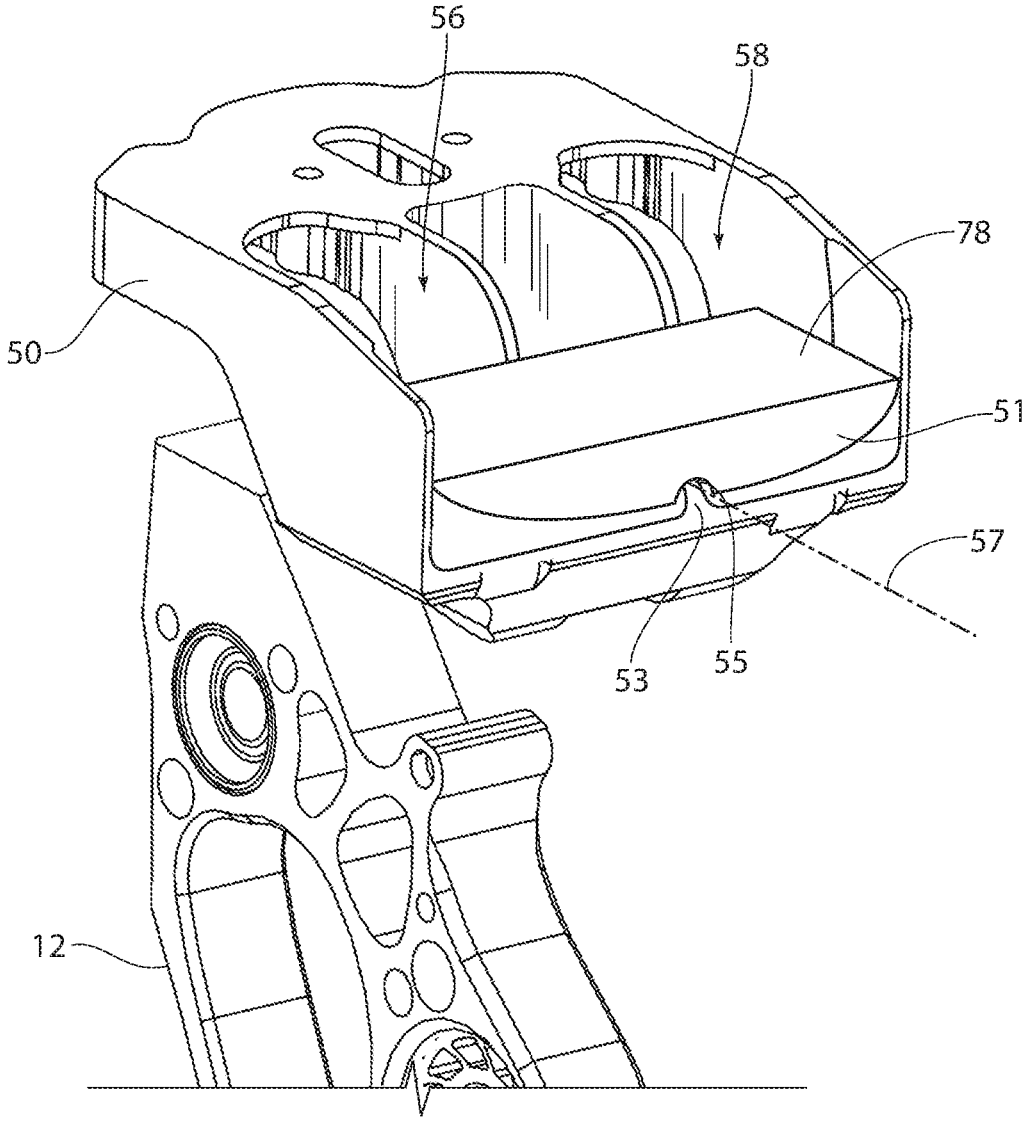
FIG. 11 shows another embodiment of a limb cup and another embodiment of a limb support structure.

FIG. 11 shows another embodiment of a limb cup 50 and another embodiment of a load balancing limb support assembly 51. In some embodiments, a load balancing limb support assembly 51 comprises a rigid member 78 that is moveable with respect to the riser 12 and/or the limb cup 50. In some embodiments, a load balancing limb support assembly 51 is pivotable. In some embodiments, a load balancing limb support assembly 51 is arranged to pivot on an axis 57 extending in a lengthwise direction of the limb members.

In some embodiments, a supporting surface 55 comprises a raised protrusion 53 and the load balancing limb support assembly 51 is arranged to pivot on the protrusion 53. In some embodiments, the load balancing limb support assembly 51 comprises a groove arranged to pivot on the protrusion 53. In various embodiments, any suitable supporting and pivoting structure can be used to support the limb portions.

In some embodiments, the limb cup 50 supports the load balancing limb support assembly 51 and the load balancing limb support assembly 51 comprises a first support portion arranged to support a first limb portion and a second support portion arranged to support a second limb portion. In some embodiments, the load balancing limb support assembly 51 is supported at a location between the first support portion and the second support portion.

In some embodiments, a load balancing limb support assembly 51 is supported directly by the riser 12. For example, in some embodiments, a separate limb cup 50 is not used.

The above disclosure is intended to be illustrative and not exhaustive. This description will suggest many variations and alternatives to one of ordinary skill in this field of art. All these alternatives and variations are intended to be included within the scope of the claims where the term "comprising" means "including, but not limited to." Those familiar with the art may recognize other equivalents to the specific embodiments described herein which equivalents are also intended to be encompassed by the claims.

Further, the particular features presented in the dependent claims can be combined with each other in other manners within the scope of the invention such that the invention should be recognized as also specifically directed to other embodiments having any other possible combination of the features of the dependent claims. For instance, for purposes of claim publication, any dependent claim which follows should be taken as alternatively written in a multiple dependent form from all prior claims which possess all antecedents referenced in such dependent claim if such multiple dependent format is an accepted format within the jurisdiction (e.g. each claim depending directly from claim 1 should be alternatively taken as depending from all previous claims). In jurisdictions where multiple dependent claim formats are restricted, the following dependent claims should each be also taken as alternatively written in each singly dependent claim format which creates a dependency from a prior antecedent-possessing claim other than the specific claim listed in such dependent claim below.

This completes the description of the preferred and alternate embodiments of the invention. Those skilled in the art may recognize other equivalents to the specific embodiment described herein which equivalents are intended to be encompassed by the claims attached hereto.

The invention claimed is:

1. An archery bow comprising:

a riser;

a limb assembly supported by the riser, the limb assembly comprising a first limb portion and a second limb portion;

a first limb support arranged to support the first limb portion, the first limb support comprising a first fluid chamber;

a second limb support arranged to support the second limb portion, the second limb support comprising a second fluid chamber;

wherein the first fluid chamber is in fluid communication with the second fluid chamber.

2. The archery bow of claim 1, comprising a fluid passageway extending between the first fluid chamber and the second fluid chamber.

3. The archery bow of claim 2, comprising a fluid reservoir, the fluid reservoir comprising the first fluid chamber, the second fluid chamber and the fluid passageway.

4. The archery bow of claim 1, comprising a hydraulic fluid.

5. The archery bow of claim 1, the first limb support comprising a first piston.

6. The archery bow of claim 5, comprising a first limb pad engaged with the first piston, the first limb pad contacting the first limb portion.

7. The archery bow of claim 5, the second limb support comprising a second piston.

8. The archery bow of claim 1, comprising a limb cup, the riser supporting the limb cup, the limb cup supporting the limb assembly.

9. The archery bow of claim 8, the limb cup comprising a first cavity and a second cavity, the first fluid chamber oriented in the first cavity and the second fluid chamber oriented in the second cavity.

10. The archery bow of claim 1, comprising a valve in fluid communication with the first fluid chamber.

11. The archery bow of claim 1, comprising a volumetric adjustment mechanism arranged to adjust an internal volume of the first fluid chamber.

12. An archery bow comprising:

a riser;

a load balancing limb support assembly supported by the riser, the load balancing limb support assembly comprising a body comprising a first support portion and a second support portion; and a limb assembly comprising a first limb portion and a second limb portion, the first limb portion supported by the first support portion, the second limb portion supported by the second support portion;

the load balancing limb support assembly comprising a fluid reservoir.

13. The archery bow of claim 12, the fluid reservoir comprising a non-rigid enclosure, the non-rigid enclosure comprising the first support portion and the second support portion.

14. The archery bow of claim 12, the fluid reservoir comprising a first fluid chamber and a second fluid chamber in fluid communication with one another, the first limb portion supported by the first fluid chamber, the second limb portion supported by the second fluid chamber.

15. The archery bow of claim 14, comprising a first piston associated with the first fluid chamber.

16. The archery bow of claim 15, comprising a second piston associated with the second fluid chamber.

17. The archery bow of claim 12, comprising a valve comprising a fluid passageway through a wall of the fluid reservoir.

18. The archery bow of claim 12, comprising a volumetric adjustment mechanism arranged to adjust an internal volume of the fluid reservoir.

19. The archery bow of claim 12, comprising a hydraulic fluid.

20. The archery bow of claim 12, the fluid reservoir comprising a sidewall of flexible material.

* * * * *